US005740263A

United States Patent [19]

Liao

[11] Patent Number: 5,740,263

[45] Date of Patent: Apr. 14, 1998

[54] MULTI-MEDIA MICROPHONE SEAT

[76] Inventor: Lu-Lee Liao, No. 5, Shi-An South Lane, Shi-Tung District, Taichung City, Taiwan

[21] Appl. No.: 731,951

[22] Filed: Oct. 23, 1996

[51] Int. Cl.[6] ..... H04R 25/00

[52] U.S. Cl. ..... 381/187; 381/183; 381/169

[58] Field of Search ..... 381/25, 183, 187, 381/205, 169, 168, 68.6, 68.7, 69, 68; 379/430, 433; 181/128, 20

[56] References Cited

U.S. PATENT DOCUMENTS 4,875,233 10/1989 Derhaag et al. ..... 381/183

5,008,943 4/1991 Arndt et al. ..... 381/68.6

5,544,253 8/1996 Nagayoshi et al. ..... 381/68.6

*Primary Examiner*—Huyen D. Le

*Attorney, Agent, or Firm*—Browdy and Neimark

[57] ABSTRACT

A multimedia microphone seat comprises a support seat and a rotating member. The support seat is provided with a round hole having in the inner wall thereof a first retaining portion. The rotating member is provided with a flange and a second retaining portion engageable with the first retaining portion. The support seat is further provided with a first locating portion, whereas the rotating member is provided with a plurality of second locating portions corresponding in location to and engageable with the first locating portion such that a plurality of locating angles are available when the rotating member is turned.

7 Claims, 3 Drawing Sheets

MULTI-MEDIA MICROPHONE SEAT

FIELD OF THE INVENTION

The present invention relates generally to a microphone seat, and more particularly to a multi-media microphone seat.

BACKGROUND OF THE INVENTION

The prior art microphone seat comprises a rotating seat provided with a combination piece edge engageable with a threaded projection located in the outer wall of a disklike retaining seat. The rotating seat can be rotated to adjust the angle so as to position the microphone at a desired level. The microphone is mounted on the rotating seat.

Such a prior art microphone seat as described above is defective in design in that the threaded projection and the retaining seat are subject to wear, and that the microphone seat can not be therefore located securely as desired.

SUMMARY OF THE INVENTION

It is therefore the primary objective of the present invention to provide a multi-media microphone seat free from the shortcoming of the prior art multi-media microphone seat.

In keeping with the principle of the present invention, the foregoing objective of the present invention is attained by an improved multi-media microphone seat, which comprises a support seat and a rotating member. The support seat is provided with a round hole having in the inner wall thereof a first retaining portion. The rotating member is provided with a flange and a second retaining portion engageable with the first retaining portion. The support seat is further provided with a first locating portion, whereas the rotating member is provided with a plurality of second locating portions corresponding in location to and engageable with the first locating portion such that a plurality of locating angles are available when the rotating member is turned.

The foregoing objective, features and advantages of the present invention will be more readily understood upon a thoughtful deliberation of the following detailed description of a preferred embodiment of the present invention in conjunction with the accompanying drawings.

DETAILED DESCRIPTION OF THE INVENTION

Figure 1:
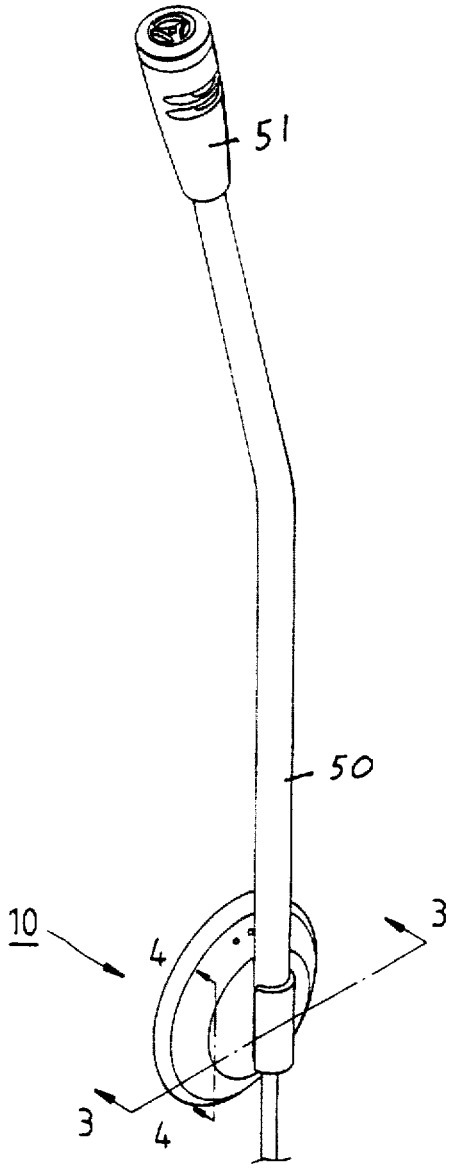
FIG. 1 shows a perspective view of the preferred embodiment of the present invention.
Figure 2:
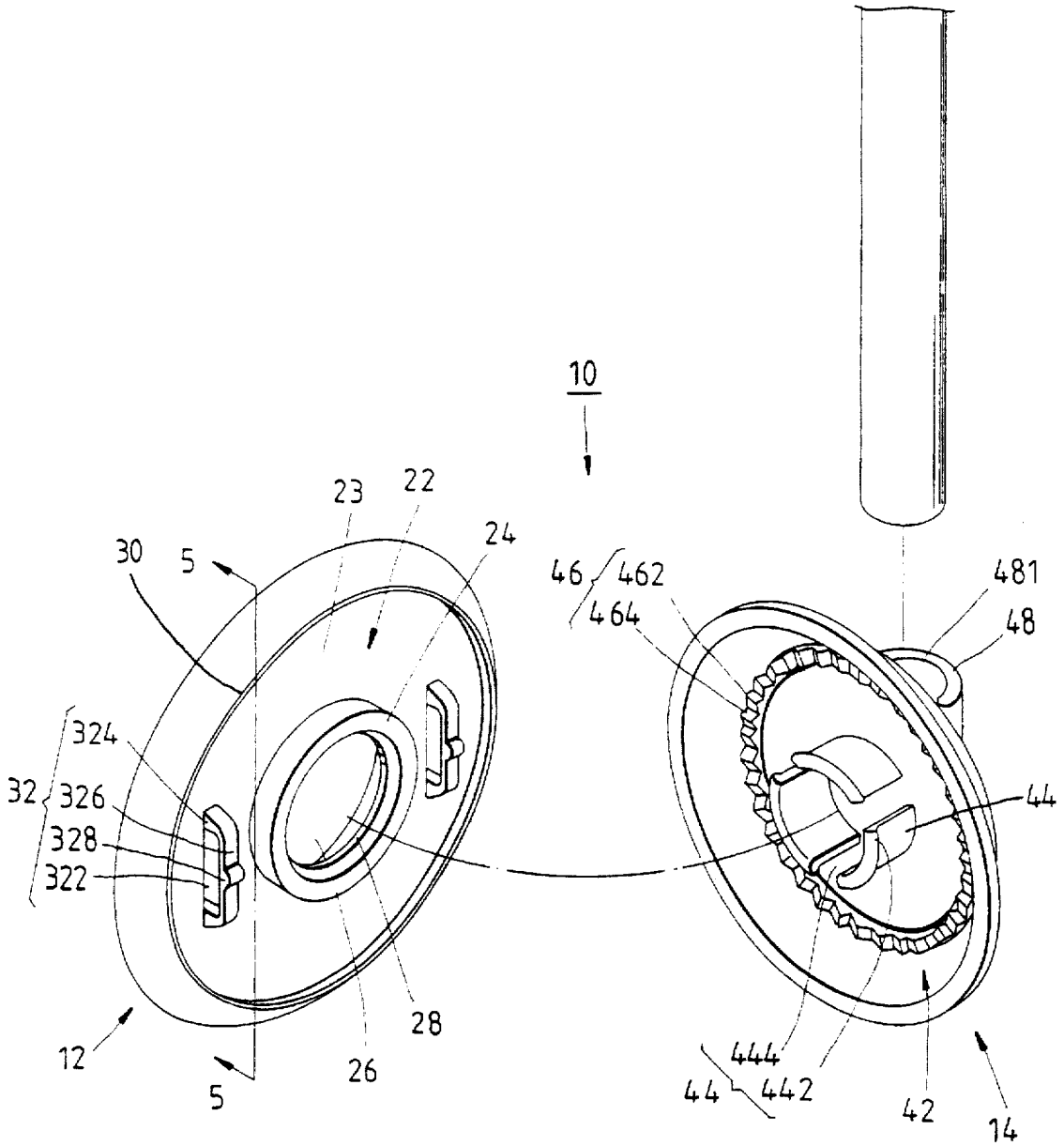
FIG. 2 shows an exploded view of the preferred embodiment of the present invention.
Figure 3:
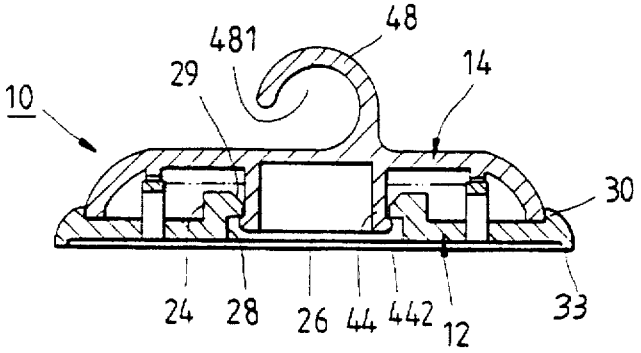
FIG. 3 shows a sectional view of a portion taken along the line 3—3 as indicated in FIG. 1.
Figure 4:
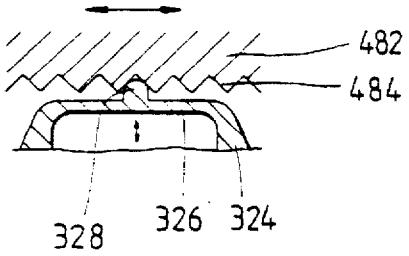
FIG. 4 shows a sectional view of a portion taken along the line 4—4 as indicated in FIG. 1.
Figure 5:
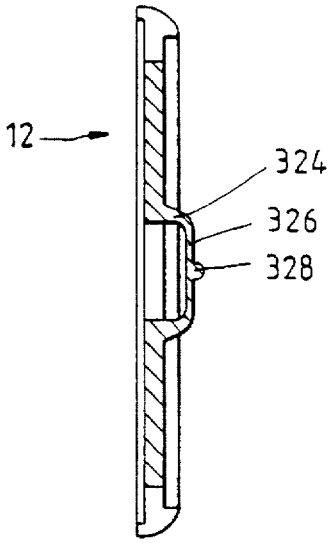
FIG. 5 shows a sectional view of a portion taken along the line 5—5 as indicated in FIG. 2.

As shown in FIGS. 1–5, an improved multimedia microphone seat 10 embodied in the present invention is composed of a support seat 12 and a rotating member 14.

The support seat 12 has a round plate 22, a first ring edge 30, and two first locating portions 32. The round plate 22 is provided at the center of one side 23 thereof with a first flange 24 and is further provided at the center thereof with a round through hole 26 which has an axis perpendicular to the one side 23. The round through hole 26 is provided in the inner wall thereof with a shoulder portion 28 and a guide angle 29 adjacent to the exit end of the flange 24. The round plate 22 is further provided on the outer edge thereof with a first ring edge 30 coaxial with and corresponding in direction to the first flange 24. The round plate 22 is still further provided on the outer edge thereof with a second ring edge 33 opposite in direction to the first ring edge 30. The first locating portions 32 are located on the side 23 such that they are equidistant from the axis of the round through hole 26. The first locating portions 32 embodied in the present invention have rectangular slots 322, which are formed respectively by with two support columns 324 and a connection plate 326. The connection plate 326 has an arcuate protuberance 328 located at the center thereof. The arcuate protuberance 328 is capable of moving along the axial direction of the support column 324.

The rotating member 14 has a disk body 42, which is provided with a second flange 44 which is capable of cooperating with the round through hole 26. The second flange 44 has a projected edge 442 capable of engaging the shoulder 28. A plurality of gaps 444 separate second flanges 44 from each other. The disk body 42 is further provided on the inner side surface thereof with a second locating portion 46, which is disposed on an equi-diametrical arcuate track corresponding to the first locating portion 32. The second locating portion 46 embodied in the present invention is composed of a protruded ring 462, and a plurality of recesses 464 having a V-shaped cross section. The disk body 42 is still further provided on the outer side surface thereof with a receiving portion 48 for receiving shaft 50 of microphone 51. The receiving portion 48 is a tube provided with a slot 49 extending along the longitudinal axis of the receiving portion 48. The slot 49 has an opening.

In combination, the second flange 44 is fitted into the through hole 26 such that second flange 44 is compressed by the guide angle 29, and that the projected edge 442 of the second flange 44 is engaged with the shoulder 28. As a result, the rotating member 14 is fastened so as to be coaxially rotatable around the axis of through hole 26 of the support seat 12. In the meantime, the arcuate protuberance 328 of the first locating portion 32 are each respectively engaged with recess 464 of the second locating portion 46.

In operation, the rod 50 of the microphone 51 is inserted into the axial hole 481 of the receiving portion 48. The level of the microphone can be adjusted precisely by turning the rotating member 14. As the connection plate 326 can be caused to move along the axial direction of the support column 324, the arcuate protuberance 328 can be moved easily between two adjoining recesses 464, thereby enabling the rotating member 14 to be mined easily. The second ring edge 33 of the support seat 12 may be provided thereon with an adhesive tape for attaching the support seat 12 with the surface of an object.

The improved multimedia microphone seat of the present invention can be assembled and disassembled easily without the use of any hand tool. In addition, the multimedia microphone seat of the present invention can be operated with precision and is durable.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A multimedia microphone seat comprising:

a support seat provided with a round hole with an axis perpendicular to a plane of the support seat, said hole having on an inner wall thereof a first retaining portion; and a rotating member provided having a flange perpendicular to a plane of the rotating member, said flange having a second retaining portion which is engaged through the inside of the round hole with said first retaining portion of said support seat so that the rotating member is coaxially rotatable around the axis of the round hole, said rotating member further provided with a receiving portion for mounting thereon a microphone;

wherein said support seat is provided with at least a first locating portion;

wherein said rotating member is provided with a plurality of second locating portions corresponding in locating to and engageable with said first locating portion of said support seat when said rotating member is rotated;

wherein said first retaining portion is a shoulder formed on said inner wall of said round hole; wherein said second retaining portion is a projected edge formed on said flange; and wherein said projected edge is engaged on said shoulder when said rotating member is joined with said support seats.

2. The multimedia microphone seat as defined in claim 1, wherein said first locating portion is a protuberance; and wherein said second locating portions are recesses.

3. The multimedia microphone seat as defined in claim 2, wherein said first locating portion comprises two support columns fastened at a first end with said support seat such that each of said support columns is perpendicular to a surface of said support seat, said support columns provided respectively on a second end thereof with a connection plate having said protuberance; and wherein said second locating portion comprises a protruded ring having a plurality of recesses engageable with said protuberance.

4. The multimedia microphone seat as defined in claim 1, wherein said receiving portion is tubular in shape and is provided with a slot having an opening and extending along the direction of a longitudinal direction of said receiving portion.

5. A multimedia microphone seat comprising:

a support seat provided with a round hole, said hole having on an inner wall thereof a first retaining portion; and a rotating member provided having a flange, said flange having a second retaining portion which is engaged through the inside of the round hole with said first retaining portion of said support seat so that the rotating member is coaxially rotatable around an axis of the round hole;

said rotating member further provided with a receiving portion for mounting thereon a microphone;

wherein said support seat is provided with at least a first locating portion; and wherein said rotating member is provided with a plurality of second locating portions corresponding in location to and engageable with said first locating portion of said support seat when said rotating member is rotated;

wherein said first locating portion is a protuberance; and wherein said second locating portions are recesses;

wherein said first locating portion comprises two support columns fastened at a first end with said support seat such that each of said support columns is perpendicular to a surface of said support seat, said support columns provided respectively on a second end thereof with a connection plate having said protuberance; and wherein said second locating portion comprises a protruded ring having a plurality of recesses located in one circle around said flange, and said plurality of recesses being engageable with said protuberance.

6. The multimedia microphone seat as defined in claim 5, wherein said first retaining portion is a shoulder formed on said inner wall of said round hole; wherein said second retaining portion is a projected edge formed on said flange; and wherein said projected edge is engaged on said shoulder when said rotating member is joined with said support seat.

7. The multimedia microphone seat as defined in claim 5, wherein said receiving portion is tubular in shape and is provided with a slot having an opening and extending along the direction of a longitudinal direction of said receiving portion.

* * * * *